US006231025B1

(12) United States Patent
Takemura

(10) Patent No.: US 6,231,025 B1
(45) Date of Patent: May 15, 2001

(54) READY-MIXED CONCRETE PLACING METHOD AND FORMWORK UNIT USED FOR THE METHOD

(75) Inventor: Yukihiro Takemura, Shimoina-gun (JP)

(73) Assignee: Takemura Kogyo Kabushiki Kaisha, Nagano (JP)

( * ) Notice: Subject to any disclaimer, the term of this patent is extended or adjusted under 35 U.S.C. 154(b) by 0 days.

(21) Appl. No.: 09/275,183

(22) Filed: Mar. 23, 1999

(30) Foreign Application Priority Data

Aug. 24, 1998 (JP) ..... 10-236694
Jan. 19, 1999 (JP) ..... 11-010177

(51) Int. Cl.[7] ..... E04B 11/06

(52) U.S. Cl. ..... 249/40; 249/18; 249/33; 249/43; 249/216; 52/426

(58) Field of Search ..... 249/18, 33, 40, 249/207, 190, 191, 216, 43; 52/426, 431, 562

(56) References Cited

U.S. PATENT DOCUMENTS 779,288 * 1/1905 Lane .
5,492,303 * 2/1996 Jaruzel ..... 249/4
5,852,907 * 12/1998 Tobin ..... 52/714

* cited by examiner

*Primary Examiner*—Carl D. Friedman
*Assistant Examiner*—Patrick J. Chavez
(74) *Attorney, Agent, or Firm*—Armstrong, Westerman, Hattori, McLeland & Naughton LLP

(57) ABSTRACT

The present invention relates to a ready-mixed concrete placing method wherein at least two holding members H comprising formwork fixing blocks 10 and threaded rods 11 screwed into tapped holes 10*a* in the formwork fixing blocks are arranged at a predetermined interval; a formwork unit configured by mounting formworks 12 on the formwork fixing blocks are placed on a foundation member 13; the threaded rods are subsequently rotated so that the formwork fixing blocks with the formworks mounted thereon are moved along the threaded rods in the vertical direction, thereby leveling the formworks; and then ready-mixed concrete is filled in a space provided between the opposed formworks up to their upper-end surfaces. The present invention improves the concrete leveling accuracy and enables even those who are not highly skilled to construct a concrete foundation with a sufficient leveling accuracy.

9 Claims, 18 Drawing Sheets

READY-MIXED CONCRETE PLACING METHOD AND FORMWORK UNIT USED FOR THE METHOD

FIELD OF THE INVENTION

The present invention relates to a ready-mixed concrete placing method for filling ready-mixed concrete between formworks disposed at a predetermined interval, and a formwork unit used for this method.

BACKGROUND OF THE INVENTION

In a conventional ready-mixed concrete placing method and an unit used for this method as shown in FIG. 18, formworks 2 and 3 are placed on a foundation, a concrete subslab, or concrete floor 1. A pair of pipes 4 and 5 are disposed in such a way as to sandwich the formworks 2 and 3 and thereby reinforce them. Ready-mixed concrete C is then filled in a space provided between the formworks 2 and 3 disposed in this manner until the concrete reaches the middle of formworks 2 and 3.

In the conventional ready-mixed concrete placing method, it is very difficult to form the horizontal upper surface of the ready-mixed concrete C filled in the space provided between the formworks 2 and 3. Even considerably skilled operators cannot level the horizontal surface of the ready-mixed concrete C precisely.

It is an object of the present invention to solve the problem of the conventional ready-mixed concrete placing method, and to provide a ready-mixed concrete placing method and associated formwork unit that enhance operability.

SUMMARY OF THE INVENTION

To achieve this object, the present invention is characterized in that at least two holding members comprising formwork fixing blocks and threaded rods screwed into tapped holes in the formwork fixing blocks are arranged at a predetermined interval, and a formwork unit configured by mounting formworks on the formwork fixing blocks is placed on a foundation member, and then the threaded rods are rotated so that the formwork fixing blocks with the formworks mounted thereon move along the threaded rods in the vertical direction, thereby leveling the formworks, and then ready-mixed concrete is filled in a space provided between the opposed formworks up to their upper end surfaces.

In addition, to attain the above object, the present invention provides a formwork unit comprising a holding member having formwork fixing blocks and threaded rods screwed into tapped holes in the formwork fixing blocks and also comprising formworks mounted on the formwork fixing blocks.

DETAILED DESCRIPTION OF THE PREFERRED EMBODIMENTS

Figure 1:
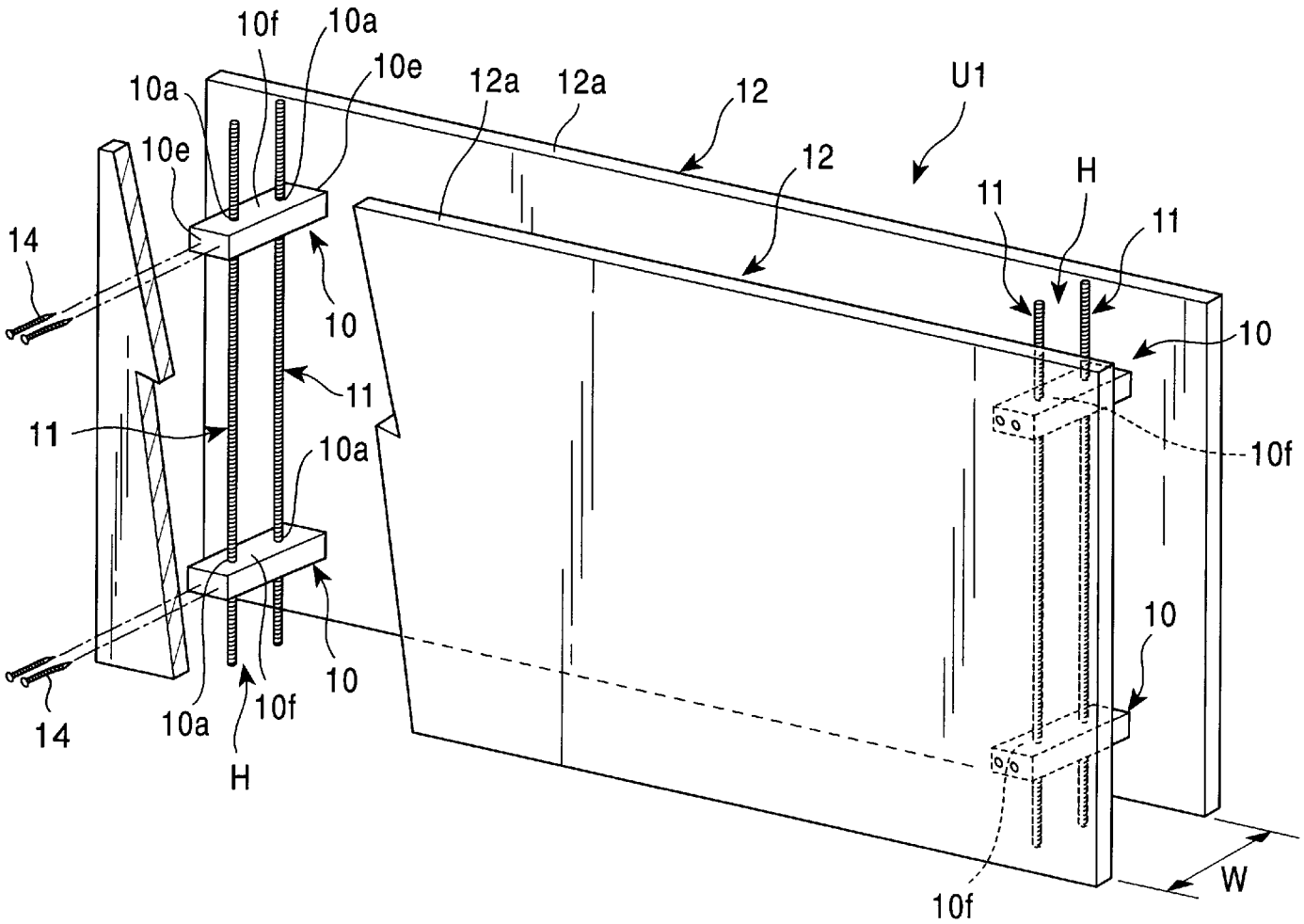
FIG. 1 is a perspective view of a formwork unit of the present invention including a partly cut out view of a formwork.
Figure 2:
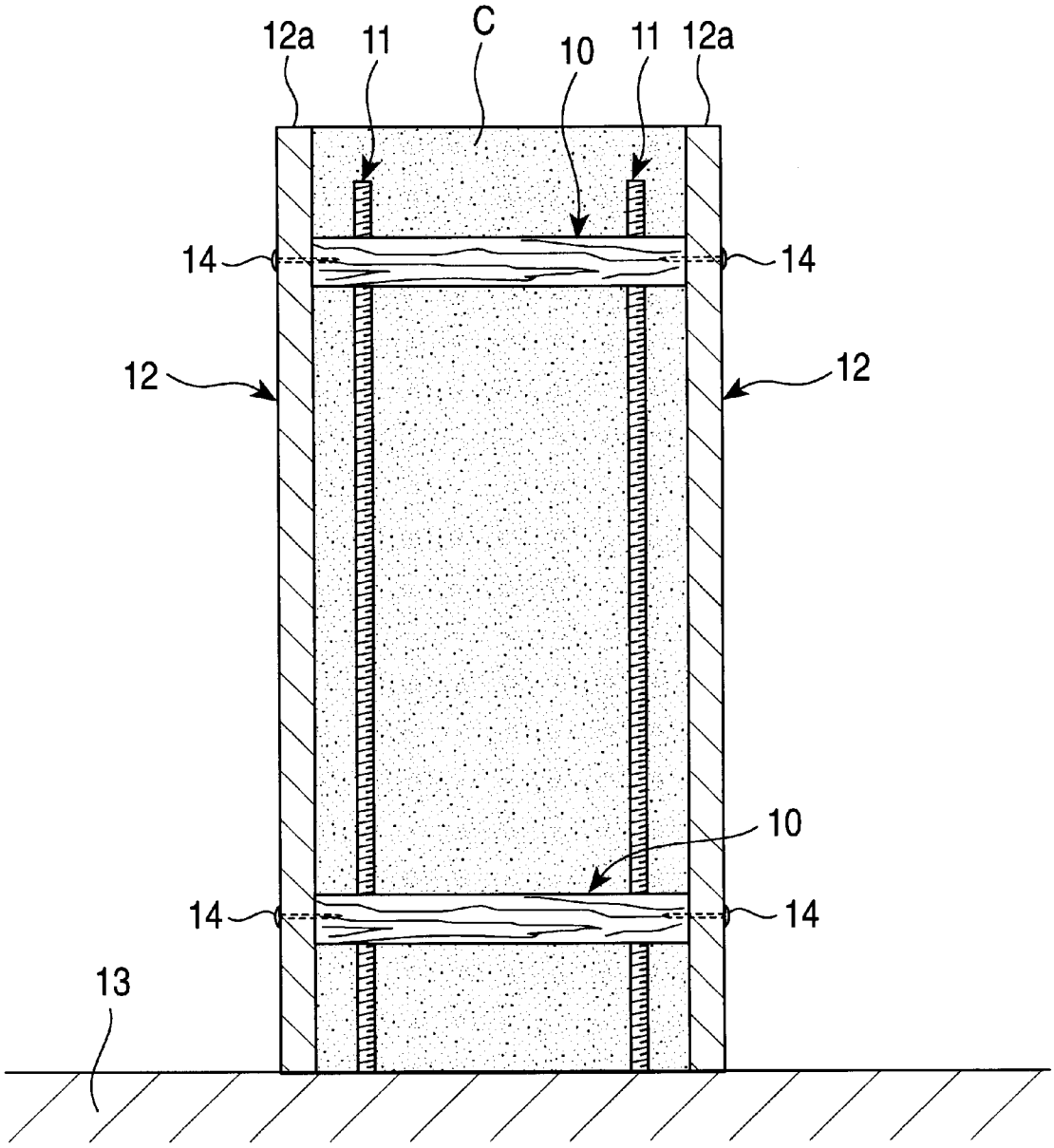
FIG. 2 is a vertical sectional view of a continuous foundation produced using the formwork unit in FIG. 1.

An embodiment of the present invention will be described below with reference to FIGS. 1 to 3.

Figure 3A:
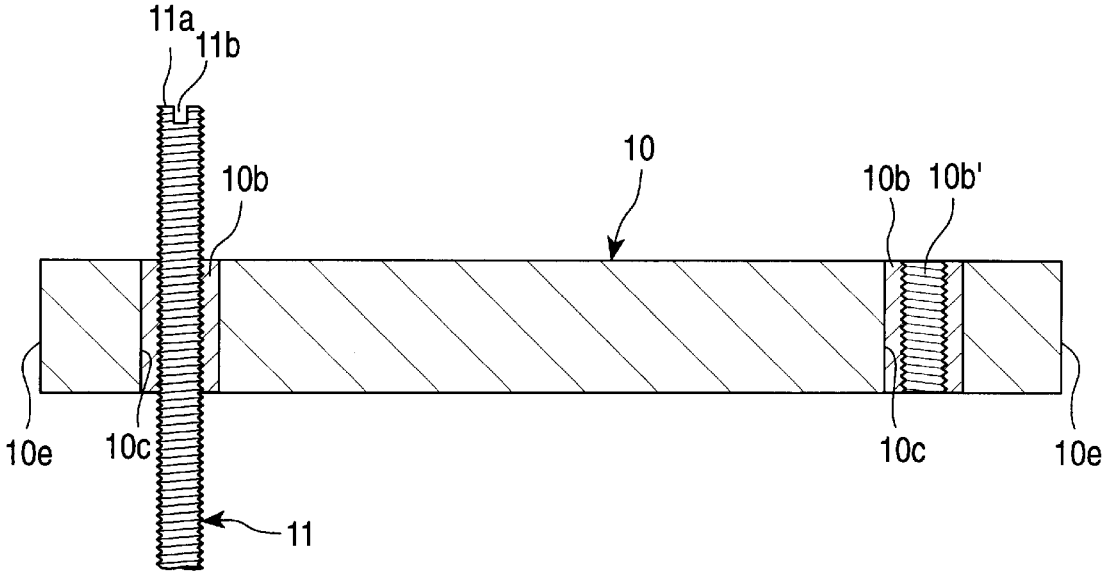
FIG. 3 is a vertical sectional view showing another embodiment of a formwork fixing block that is used in a method for constructing a continuous foundation according to the present invention.
Figure 3B:
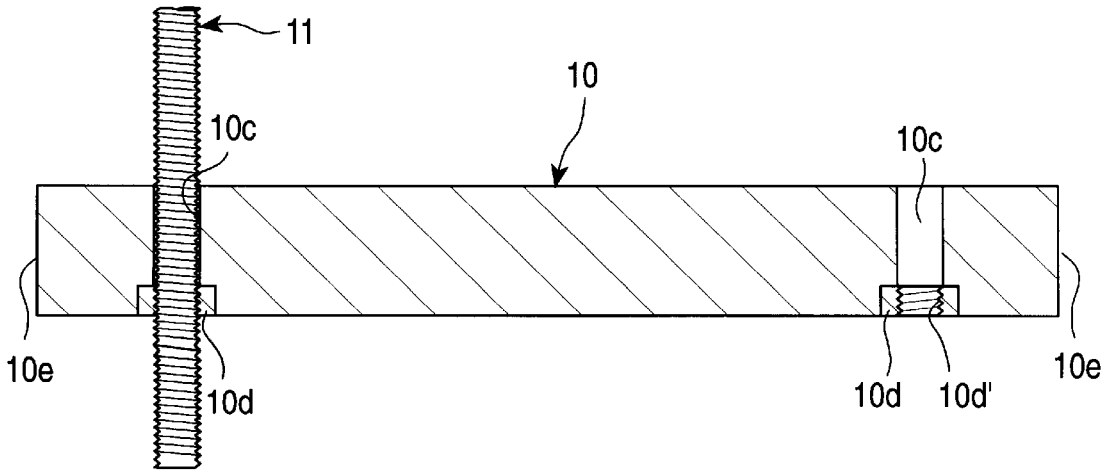

10 is a formwork fixing block. Two vertical tapped holes 10*a* are formed in the formwork fixing block 10 at a predetermined interval. The formwork fixing block 10 can be formed of various materials such as wood, metal, or synthetic resin. Although the tapped holes 10*a* may be directly formed in the formwork fixing block 10, a tapped groove 10*b′* may be engraved in the inner circumferential surface of each cylinder 10*b* of metal or hard synthetic resin, as shown in FIG. 3A, and these cylinders 10*b* may be fitted in vertical holes 10 *c* drilled in the formwork fixing block 10 to form the tapped holes 10*a* in the formwork fixing block 10. In addition, as shown in FIG. 3B, a nut 10*d* having a tapped groove 10*d′* engraved in inner circumferential surface and having a larger outer diameter than the inner diameter of the vertical hole 10*c* is fitted in each of the vertical holes *c* formed in the formwork fixing block 10, so as to form the tapped holes 10*a* therein. As described below, the nut 10*d* is preferably fitted under the vertical hole 10*c* so as not to slip out from the hole 10*c* if a downward load is applied to the formwork fixing block 10.

11 is a threaded rod having a threaded portion that can be screwed in the vertical tapped hole 10*a* formed in the formwork fixing block 10. The threaded rod 11 may be threaded over its entire length, as shown in FIG. 1 and FIG. 2, or over a predetermined length corresponding to the portion of rod 11 which is screwed into the formwork fixing block 10.

A straight groove 11*b* is formed in the top 11*a* of the threaded rod 11 so that a flat screwdriver can be inserted into the groove 11*b*. Of course, a cross-head groove may also be formed so that a Phillips screwdriver can be inserted into it. In addition, a hexagonal or other polygonal hole may be formed so that a screwdriver with a polygonal tip such as an Allen wrench can be inserted into it. Furthermore, the upper end of the threaded rod 11 may be formed with a polygonal geometry so that a spanner or an offset wrench can be attached to it. As described above, in the threaded rod 11, a threaded rod rotating means such as a straight groove 11*b*, or a cross-head groove, or a hexagonal or other polygonal hole, or a polygonal geometry is disposed, and the threaded rod 11 may be rotated by using a threaded rod rotating tool such as a flat or Phillips screwdriver that engages the threaded rod rotating means. A cutting plier or an appropriate threaded rod rotating tool may be used to rotate the threaded rod 11 without disposing the threaded rod rotating means, such as a straight groove 11*b* and a cross-head groove. 12 is a plate-like formwork.

Next, an assembly process for the formwork fixing block 10, the threaded rod 11, and the formwork 12 is described.

The two threaded rods 11 are screwed in the two respective vertical tapped holes 10*a* in each of the upper and lower formwork fixing blocks 10, and the two formwork fixing blocks 10 are arranged in the vertical direction at a predetermined interval. Two or more holding members H each having the two threaded rods 11 screwed in the two respective vertical tapped holes 10*a* in the formwork fixing blocks 10 arranged in the vertical direction are disposed on a foundation such as a horizontal floor. In this case, the threaded rods 11 are placed on a foundation member 13. FIG. 1 shows an example in which the two holding members H are disposed in the horizontal direction at a predetermined interval. This embodiment is not limited to the two vertical formwork fixing blocks 10, as three or more such blocks may also be arranged.

Next, the formworks 12 contact the opposed side wall surfaces 10*e* of the formwork fixing block 10 that are perpendicular to an imaginary vertical surface joining together the axes of the two threaded rods 11 screwed in the single formwork fixing block 10, and then the formworks 12 are mounted on the formwork fixing blocks 10 using appropriate fixing means. If the formwork fixing blocks 10 and the formworks 12 permit the use of nails or screws as a fixing means, nails or screws may be used to mount the formworks 12 on the formwork fixing blocks 10. In this case, the upper end surfaces 12*a* of the two formworks 12 mounted on the opposed side wall surfaces 10*e* of the formwork fixing block 10 are located at the same distance from the top surface 10*f* of the formwork fixing block 10. FIG. 1 and FIG. 2 show an example in which the formworks 12 are mounted on the formwork fixing blocks 10 using screws 14. Although the formworks 12 may be mounted on the two formwork fixing blocks 10 arranged in the vertical direction using the fixing means, the formwork 12 may also be mounted on only one of these two formwork fixing blocks 10.

Next, the formwork unit U1, which has been assembled as described above, is placed on the foundation member 13 such as a foundation, a concrete subslab, or concrete floor which is formed at the site. Subsequently, a level or other appropriate leveling device is placed on the upper end surface 12*a* of the formwork 12 or the leveling device is placed across the opposed formworks 12, and attaching the threaded rod rotating tool to the threaded rod 11 which is screwed in the tapped hole 10*a* in the formwork fixing block 10, and then rotating the threaded rod rotating tool engaged with the threaded rod 11. The rotation of the threaded rods 11 causes the formwork fixing blocks 10 with the formworks 12 mounted thereon to move in the vertical direction relative to the threaded rods 11. The vertical positions of the opposed formworks 12 are adjusted through this movement using the two respective holding members H. In this manner, leveling is executed so that the horizontal levels of the upper end surfaces 12*a* of the opposed formworks 12 are equal.

After the threaded rods 11 have been rotated to level the horizontal surfaces of the formworks 12 mounted on the formwork fixing blocks 10 as described above, ready-mixed concrete C is filled in a space provided between the opposed formworks 12 up to the upper end surfaces 12*a* of the formworks 12 for which leveling has been finished. Once the ready-mixed concrete C has been set, the formworks 12 are removed to form a continuous foundation. This assembly, however, may be used as a continuous foundation without removing the formworks 12. It will be appreciated that reinforcement can be positioned in the space provided between the opposed formworks 12, after which the ready-mixed concrete C would be filled into the space.

As described above, after the horizontal surfaces of the formworks 12 mounted on the formwork fixing blocks 10 have been leveled, the ready-mixed concrete C is filled in the space provided between the opposed formworks 12 up to the upper end surfaces 12*a* of the formworks 12, for which leveling has been finished. Thus, the accuracy in leveling the horizontal surface of the ready-mixed concrete C is improved, and even those who are not highly skilled can construct a concrete foundation with sufficient leveling accuracy In addition, because the formworks 12 are mounted on the formwork fixing blocks 10, when the ready-mixed concrete C is filled in the space provided between the opposed formworks 12, the formworks 12 can be prevented from moving away from each other due to the ready-mixed concrete C. Thus, the need to dispose a pair of pipes 4 and 5 in such a way as to sandwich the formworks 2 and 3 is eliminated. Consequently, the installation time for the formworks can be reduced, thereby reducing the overall construction time. However, if necessary, pipes 4 and 5 can be used for reinforcing the formworks 12.

The thickness of the constructed concrete can be changed as needed by changing the distance between the opposed side wall surfaces 10*e* of the formwork fixing block 10. The height of the concrete can also be changed as needed by changing the height of the formworks 12.

The top 11*a* of the threaded rod 11 is preferably adjusted to rest slightly below the top surface of the filled ready-mixed concrete C, that is, the upper end surface 12*a* of the formwork 12. The upper part of the threaded rod 11, however, may extend a certain distance beyond the top surface of the ready-mixed concrete C, that is, the upper end surface 12*a* of the formwork 12, so that the exposed portion may be used to mount a construction material on the continuous foundation. This configuration enables the threaded rods 11 to also be used as anchor bolts to mount a construction material on the continuous foundation, thereby eliminating the need to install anchor bolts. This feature reduces the construction time for the continuous foundation and thus the overall construction period.

This embodiment shows an example in which the tapped holes 10*a* are formed in two vertically arranged formwork fixing blocks 10, and the threaded portions of the threaded rods 11 are screwed in both formwork fixing blocks 10 with tapped holes 10*a* formed therein. The tapped holes 10*a*, however, may be formed in one of these two formwork fixing blocks 10, while the holes formed in the other formwork fixing block 10 may be unthreaded. In this case, when the threaded rods 11 are rotated, only the formwork fixing block 10 with the tapped holes 10*a* formed therein moves the formworks 12 mounted on this formwork fixing block 10. The formwork fixing block 10 with the unthreaded holes formed therein does not have the function of moving the formworks 12 in the vertical direction, but can restrict the lateral movement of the threaded rods 11 to prevent them from being bent as a result of the lateral movement. Preferably, the threaded holes 10*a* are formed in the upper formwork fixing block 10, whereas the holes formed in the lower block 10 are unthreaded.

As described above, preferably, before the formwork unit U1 is transported to and installed at the construction site, it should be assembled in a factory according to the procedure described below in detail.

The two threaded rods 11 are screwed into the two vertical tapped holes 10*a* of the formwork fixing block 10 arranged in the vertical direction to assemble the holding member H. Then, for example, the two holding members H are arranged on a horizontal floor surface or a appropriate horizontal foundation surface at a predetermined interval, and the threaded rods 11 are subsequently rotated as needed to move the formwork fixing blocks 10 in the vertical direction. This adjusts their positions so that at least the upper formwork fixing block 10 is constantly located at a specified position relative to the upper end surfaces 12*a* of the formworks 12. Then, the two formworks 12 are mounted on the opposed side wall surfaces 10*e* of the formwork fixing blocks 10 to assemble the formwork unit U1 as shown in FIG. 1. The formwork unit U1 assembled in a factory in this manner is transferred to the construction site and placed on the foundation member 13, such as a foundation, concrete subslab, or concrete floor which is formed at the site. Then, as described above, the threaded rods 11 are rotated to execute leveling such that the horizontal levels of the upper end surfaces 12*a* of the opposed formworks 12 are equal. Due to this pre-assembly of the formwork unit U1 in the factory and the subsequent placement of the formwork unit U1 on the foundation member 13 for leveling, the horizontal surfaces of the formworks 12 of the formwork unit U1 can be leveled in a short time to reduce the construction time for the continuous foundation, as well as the overall construction period.

Next, another embodiment of the present invention will be described with reference to FIGS. 4 to 7.

In the conventional method, inverse-T-shaped reinforcing materials 15*a* are arranged at a predetermined interval, an appropriate number of horizontal reinforcements 15*b* are attached to the vertical portions 15*a'* of the reinforcing materials 15*a* to constitute a reinforcing member 15, and this reinforcing member 15 is disposed on the foundation member 13 via stones or concrete blocks 16. In an attempt to place the formwork unit U1 onto the foundation member 13, while pushing down the formwork unit U1 from above the reinforcing member 15 having the horizontal reinforcement 15*b*, in such a manner as to sandwich the reinforcing member 15, the lower formwork fixing block 10 strikes the horizontal reinforcement 15*b*. Thus the formwork unit U1 cannot be placed on the foundation member 13. If the formwork unit U1 is placed on the foundation member 13, the top horizontal reinforcement 15*b* of the reinforcing member 15 is located below the bottom surface of the upper formwork fixing block 10, thereby preventing the top horizontal reinforcement 15*b* from abutting on the upper formwork fixing block 10. In addition, instead of providing the reinforcing member 15 on the foundation member 13 via the stones or concrete blocks 16, the lower parts of the reinforcement materials 15*a* may be buried and placed in the concrete subslab or concrete floor that constitutes the foundation member 13.

Thus, this embodiment divides the lower formwork fixing block 10 into two formwork fixing blocks 10'. Each divided formwork fixing block 10' has a tapped hole 10*a* respectively in which the threaded rod 11 is screwed or a unthreaded hole through which the threaded rod 11 passes. The formworks 12 are then fixed to the divided formwork fixing blocks 10' using the screws 14 or other fixing means. Since a gap d through which the horizontal reinforcement 15*b* of the reinforcing member 15 can pass is formed between the two lower divided formwork fixing blocks 10', this configuration enables the formwork unit U1 to be placed on the foundation member 13 by lowering the formwork unit U1 from above the reinforcing member 15 having the horizontal reinforcements 15*b*. In this case, the horizontal reinforcement 15*b* passes through the gap d, while it is also possible that the vertical portion 15*a'* of the reinforcing member 15 passes through the gap d.

Figure 6:
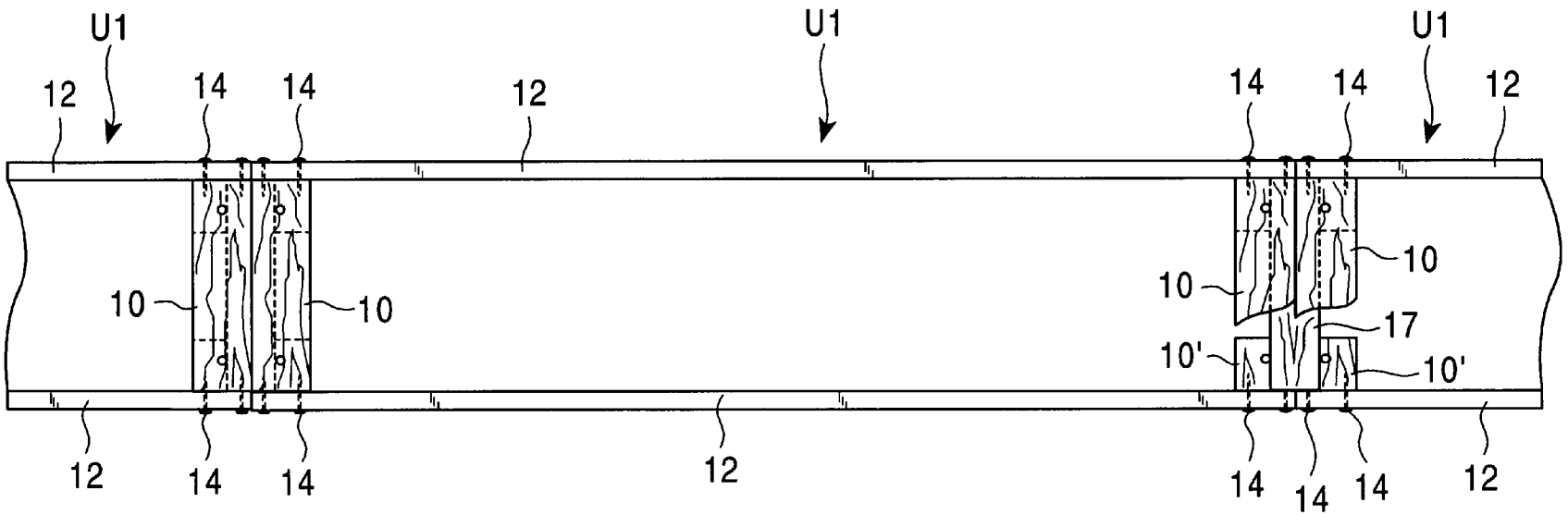
FIG. 6 is a top view of a plurality of formwork units coupled together according to the present invention.
Figure 7:
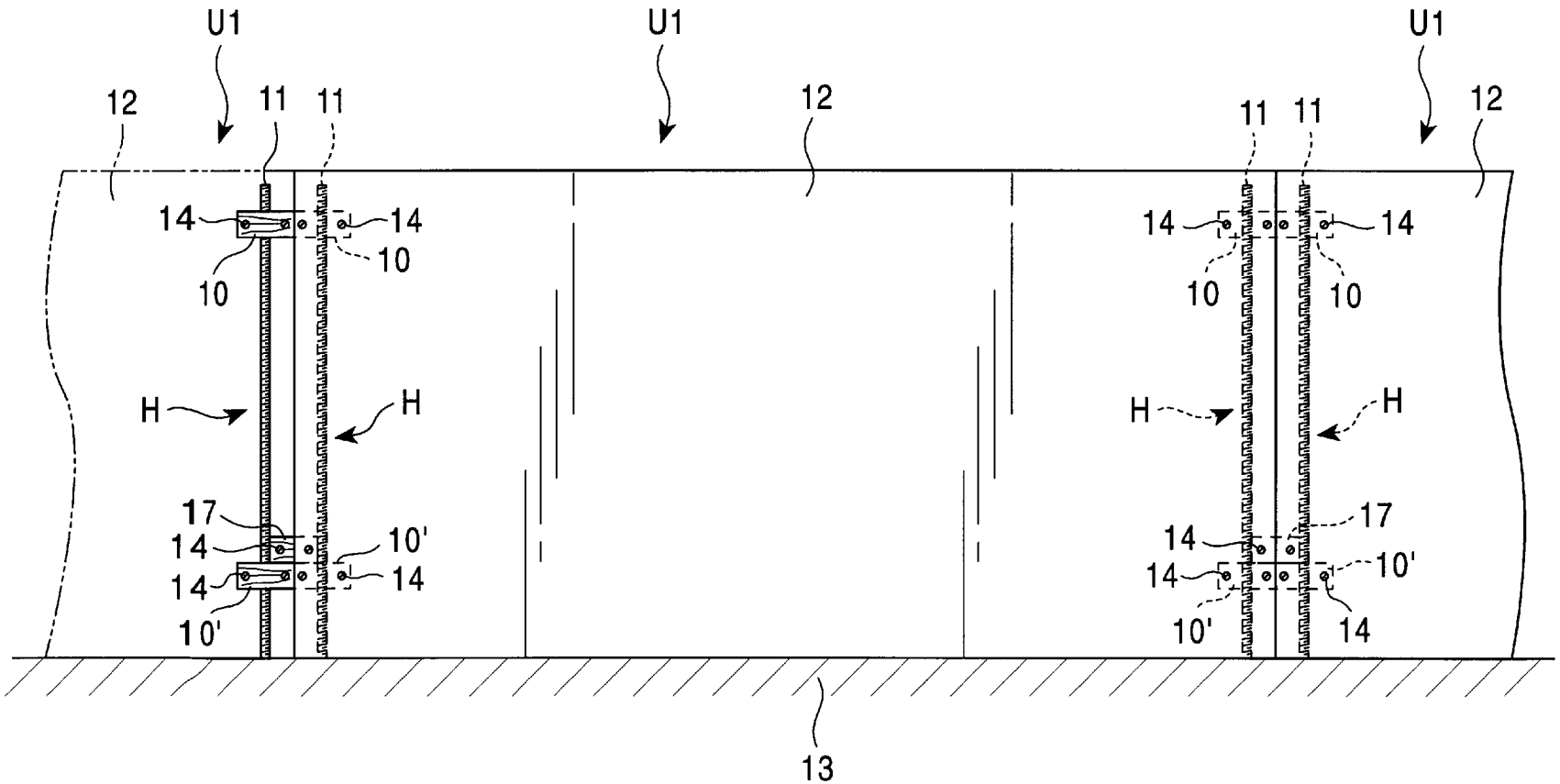
FIG. 7 is a frontal view a plurality of formwork units coupled together according to the present invention.

17 is a plate-like connecting member that is used to connect two formwork units U1 together and that has a width w' nearly equal to the inner width w between the two formworks 12 mounted on the formwork fixing block 10. A plurality of formwork units U1 can be connected together as shown in FIG. 6 and FIG. 7. This is accomplished by fitting approximately half of the connecting member 17 between the formworks 12 of the adjacent formwork units U1 in such a way that the vertical end surfaces 12*b* of the formwork units U1 abut each other and by subsequently mounting the connecting member 17 on the formworks 12 using appropriate fixing means such as screws 14.

Figure 4:
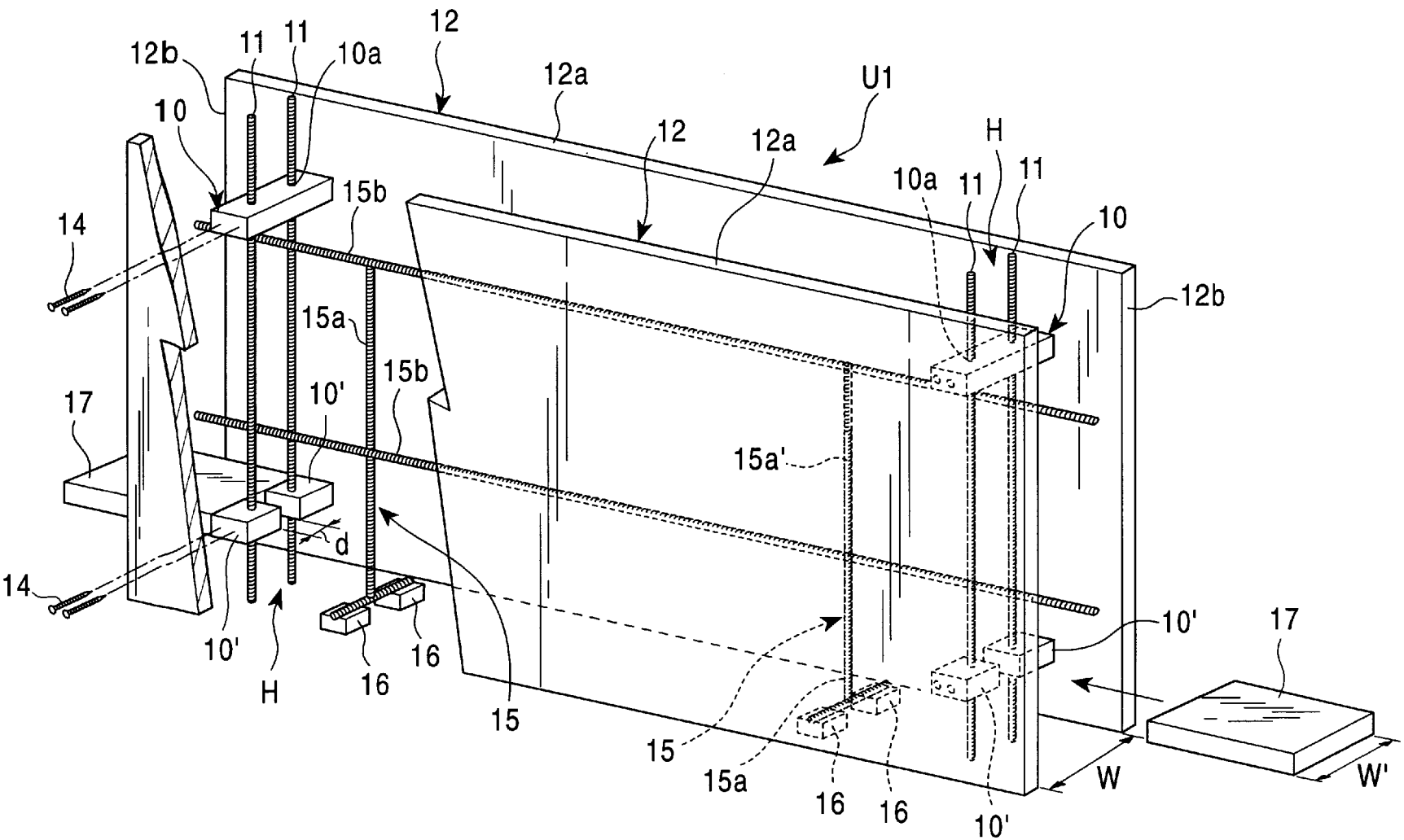
FIG. 4 is a perspective view of an another embodiment of a formwork unit of the present invention including a partly cut out view of a formwork.
Figure 5:
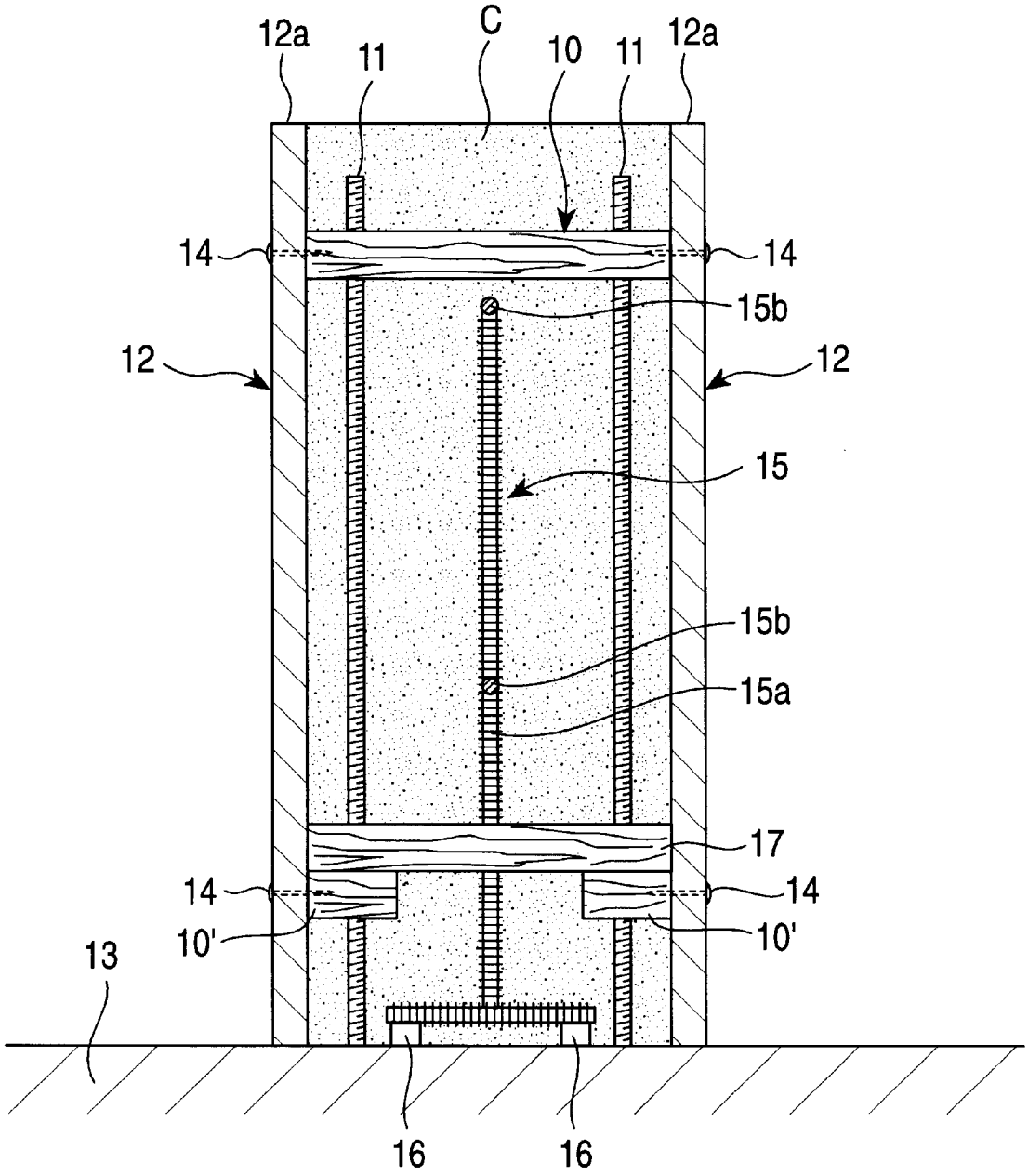
FIG. 5 is a vertical sectional view of a continuous foundation produced using the formwork unit shown in FIG. 4.

The mounting position of the connecting member 17 can be set in the vertical direction as required. If, however, the lower formwork fixing block is the divided formwork fixing blocks 10', nothing couples the lower parts of the opposed formworks 12 together, so the ready-mixed concrete C filled between the formworks 12 may move the formworks 12 away from each other. Thus, in this case, the connecting member 17 is preferably mounted adjacent to or near the divided formwork fixing blocks 10', as shown in FIGS. 4, 5, and 7.

Figure 8:
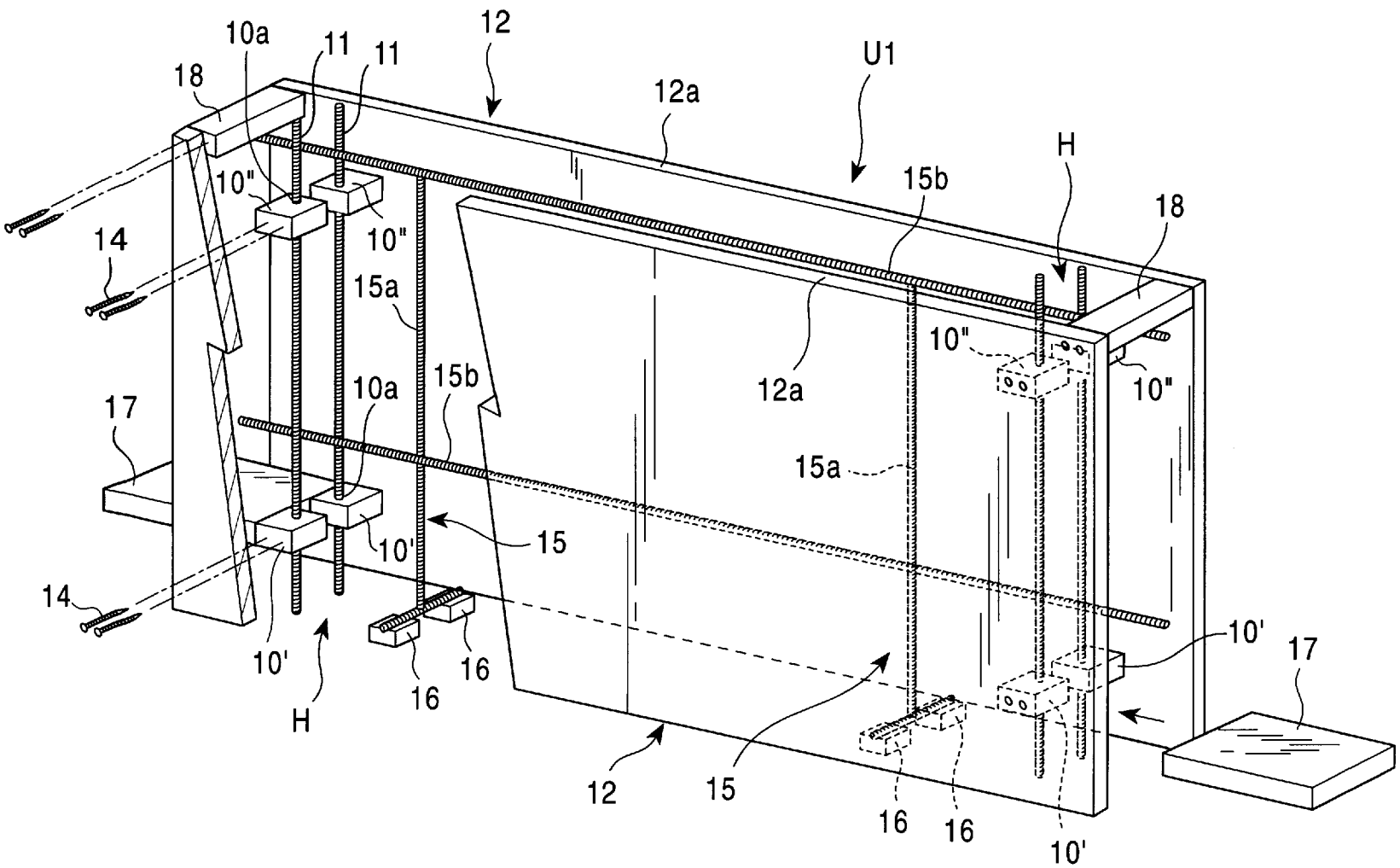
FIG. 8 is a perspective view of an yet another embodiment of a formwork unit of the present invention including a partly cut out view of a formwork.
Figure 9:
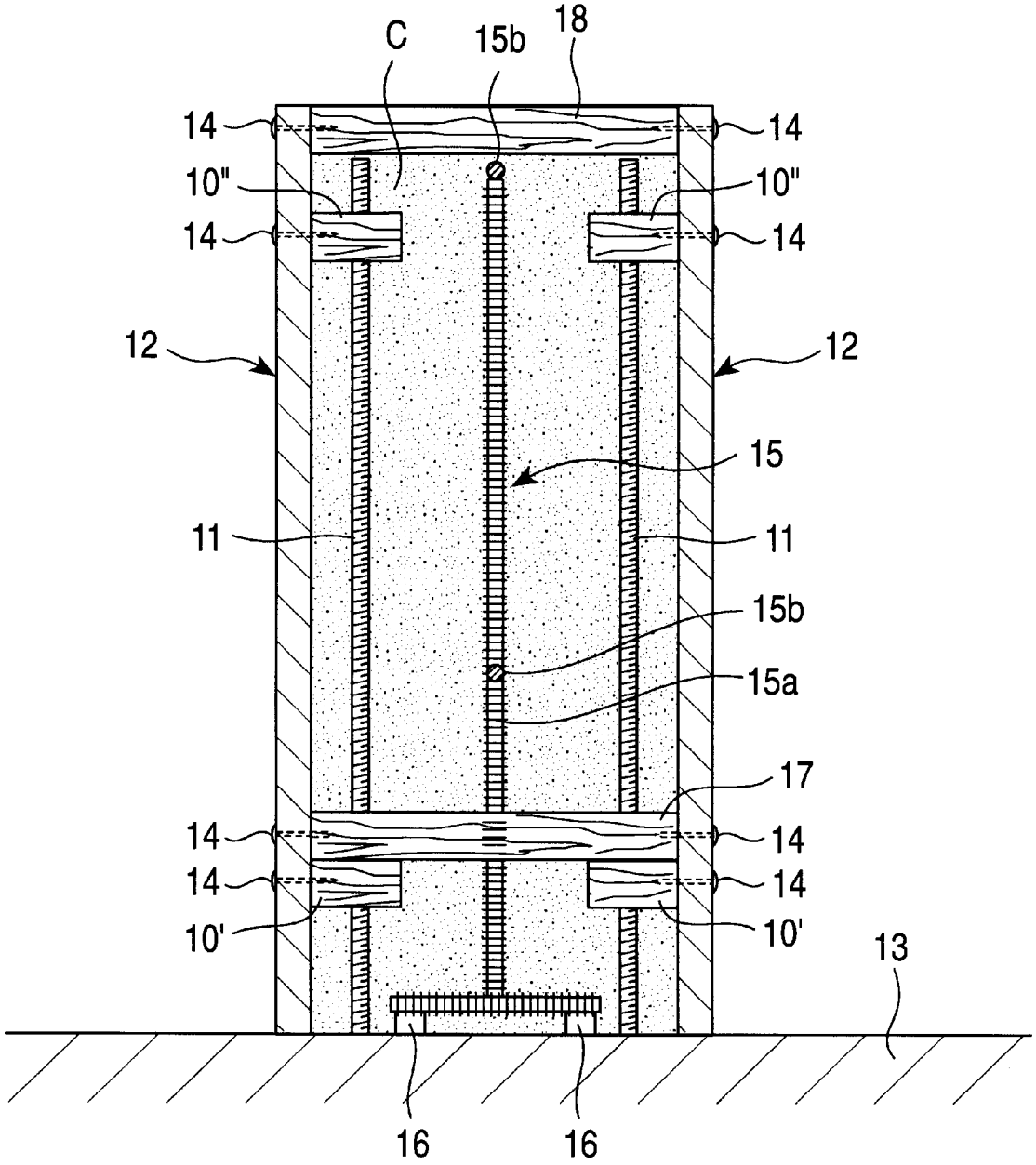
FIG. 9 is a vertical sectional view of a continuous foundation produced using the formwork unit shown in FIG. 8.

According to the embodiment shown in FIG. 8 and FIG. 9, the upper formwork fixing block 10 in the above embodiments also comprises divided formwork fixing blocks 10". In this case, since nothing couples the opposed formworks 12 together, a coupling block 18 that couples the opposed formworks 12 together is inserted near the top of the opposed formworks 12, and the screws 14 are used to mount the coupling block 18 on the formworks 12. By using the divided formwork fixing block 10' as the lower formwork fixing block and the divided formwork fixing block 10" as the upper formwork fixing block, the upper horizontal reinforcement 15*b* of the reinforcing member 15 can pass between the upper divided formwork fixing blocks 10". As a result, the upper horizontal reinforcement 15*b* can be located above the upper formwork fixing block 10 to increase the user's degrees of freedom in locating the reinforcing member 15.

Figure 10:
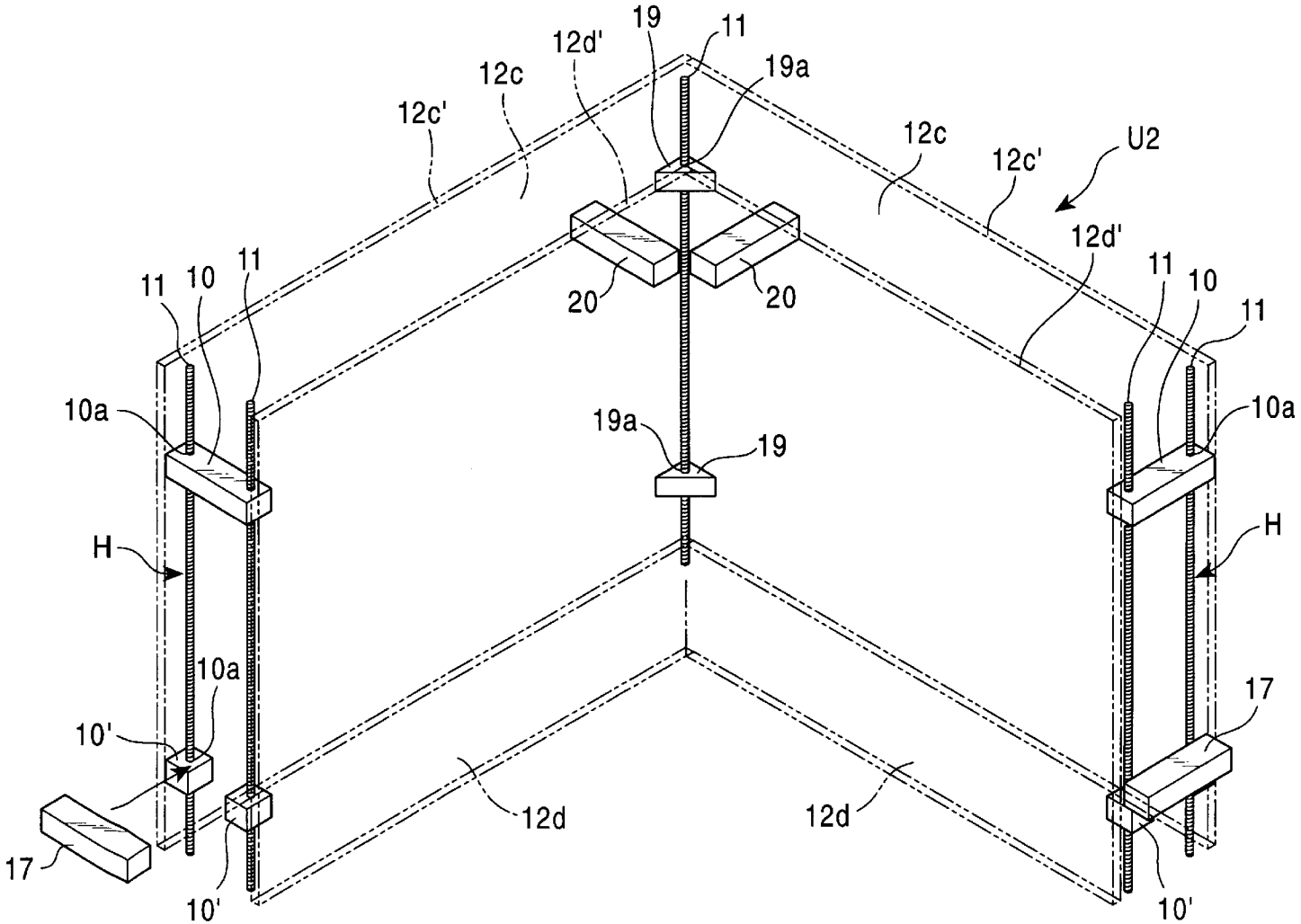
FIG. 10 is a perspective view of still another embodiment of a formwork unit of the present invention.
Figure 11:
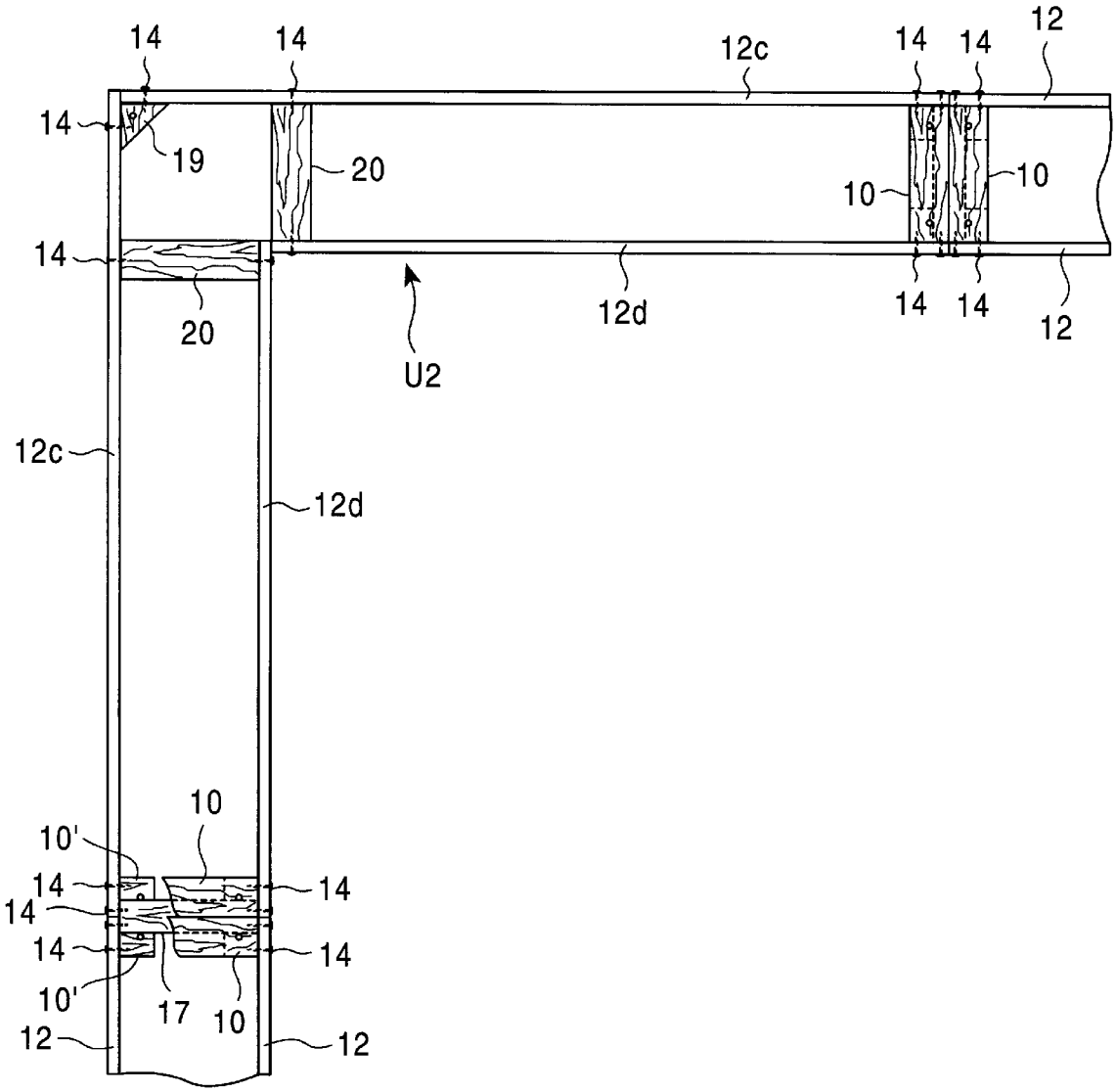
FIG. 11 is a top view of the formwork unit shown in FIG. 10.

A formwork unit U2 that differs from the above-described formwork unit U1 will be described below with reference to FIG. 10 and FIG. 11. The formwork unit U1 is used to install a linear continuous foundation, whereas the formwork unit U2 shown in FIG. 10 and FIG. 11 is used to install a continuous foundation that appears L-shaped as viewed from above.

Two outer formworks 12*c* of the approximately same size are arranged in such a way as to appear L-shaped as viewed from above, and inner formworks 12*d* shorter than the outer formworks 12*c* are similarly arranged within the corner of the outer formworks 12*c* that forms an angle of 90 degrees. Then, the holding members H, each comprising the two formwork fixing blocks 10 arranged in the vertical direction (FIG. 10 and FIG. 11 show the case of divided formwork fixing blocks 10' formed by dividing the lower formwork fixing block into two) and two threaded rods 11 screwed into the vertical tapped holes 10*a* in each formwork fixing block 10 are mounted near the respective ends of the outer formworks 12*c* and inner formworks 12*d*. Two formwork fixing blocks 19 both shaped to appear triangular as viewed from above are vertically arranged in the corner of the outer formworks 12*c* forming an angle of 90 degrees. The outer formworks 12*c* are mounted on the formwork fixing blocks 19 using the screws 14 or other fixing means as described above. A vertical tapped hole 19*a* is engraved in the triangular formwork fixing block 19 as in the formwork fixing block 10, and the above threaded rod 11 is screwed into the tapped hole 19*a*. Although threaded rods 11 can be screwed into the vertical tapped hole 19*a* of the lower triangular formwork fixing block 19, unthreaded holes may be formed in the lower triangular formwork fixing block 19.

As in the formwork unit U1, in mounting the outer formworks 12*c* and the inner formworks 12*d* on the formwork fixing blocks 10 and the trianglular formwork fixing blocks 19, the positions of the formwork fixing blocks 10 and the trianglular formwork fixing blocks 19 is adjusted so that at least the upper formwork fixing block 10 and the upper triangle formwork fixing block 19 are constantly located at specified positions relative to the upper end surfaces 12*c'* of the outer formworks 12*c* and the upper end surfaces 12*d'* of the inner formworks 12*d*. Moreover, the upper end surfaces 12*c'* of the outer formworks 12*c* and the upper end surfaces 12*d'* of the inner formworks 12*d* are configured to be flush with each other.

20 is spacers that prevent the outer formworks 12*c* and the inner formworks 12*d* from moving away from each other due to ready-mixed concrete filling in the space formed by the outer formworks 12*c* and the inner formworks 12*d*. The spacers 20 couple the outer formworks 12*c* and the inner formworks 12*d* together to keep the interval between them at a predetermined value. The spacers 20 are mounted using screws 14 or other fixing means between the outer formworks 12*c* and the inner formworks 12*d* at appropriate positions, such as near the corner of the formwork unit U2.

The formwork unit U2 assembled in the above manner and appearing L-shaped as viewed from above is placed on the foundation member. Then, a level or other appropriate leveling device is placed on the upper end surfaces 12*c'* of the outer formworks 12*c* and the upper end surfaces 12*d'* of the inner formworks 12*d*, or across the opposed formworks 12*c* and 12*d*. And then, the threaded rod 11 is rotated by using the threaded rod rotating tool which is attached to the threaded rod 11. The rotation of the threaded rods 11 causes the formwork fixing blocks 10 or the trianglular formwork fixing blocks 19 with the outer and inner formworks 12*c* and 12*d* mounted thereon to move in the vertical direction relative to the threaded rods 11. Doing this adjusts the vertical positions of the opposed formworks 12*c* and 12*d* and levels the horizontal surfaces of the formworks 12*c* and 12*d*. Subsequently, the ready-mixed concrete C is filled in the space provided between the opposed formworks 12*c* and 12*d* up to the upper end surfaces 12*c'* and 12*d'* of the formworks 12*c* and 12*d*, for which leveling has been finished. Once the ready-mixed concrete C has been set, the formworks 12*c* and 12*d* are removed to form a continuous foundation that appears L-shaped as viewed from above. This assembly, however, may be used as a continuous foundation without removing the formworks 12*c* and 12*d*. In addition, as described above, the connecting members 17 can be used to connect together the formwork units U2 that appear L-shaped as viewed from above or to connect this formwork unit U2 with the linear formwork unit U1 or a formwork unit U3 that appears T-shaped as viewed from above. The T-shaped formwork unit is described below.

Figure 12:
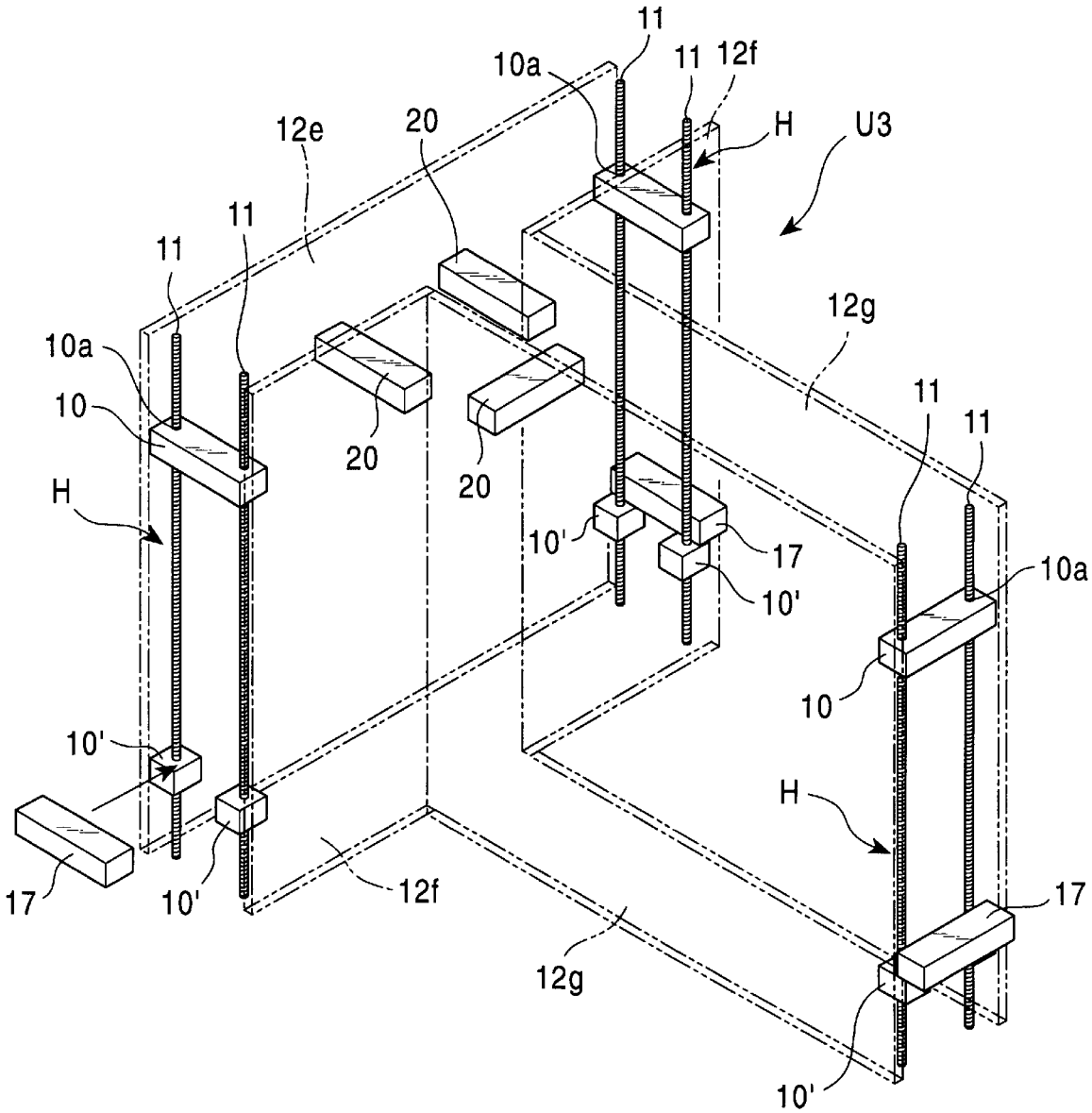
FIG. 12 is a perspective view of still another embodiment of a formwork unit of the present invention.
Figure 13:
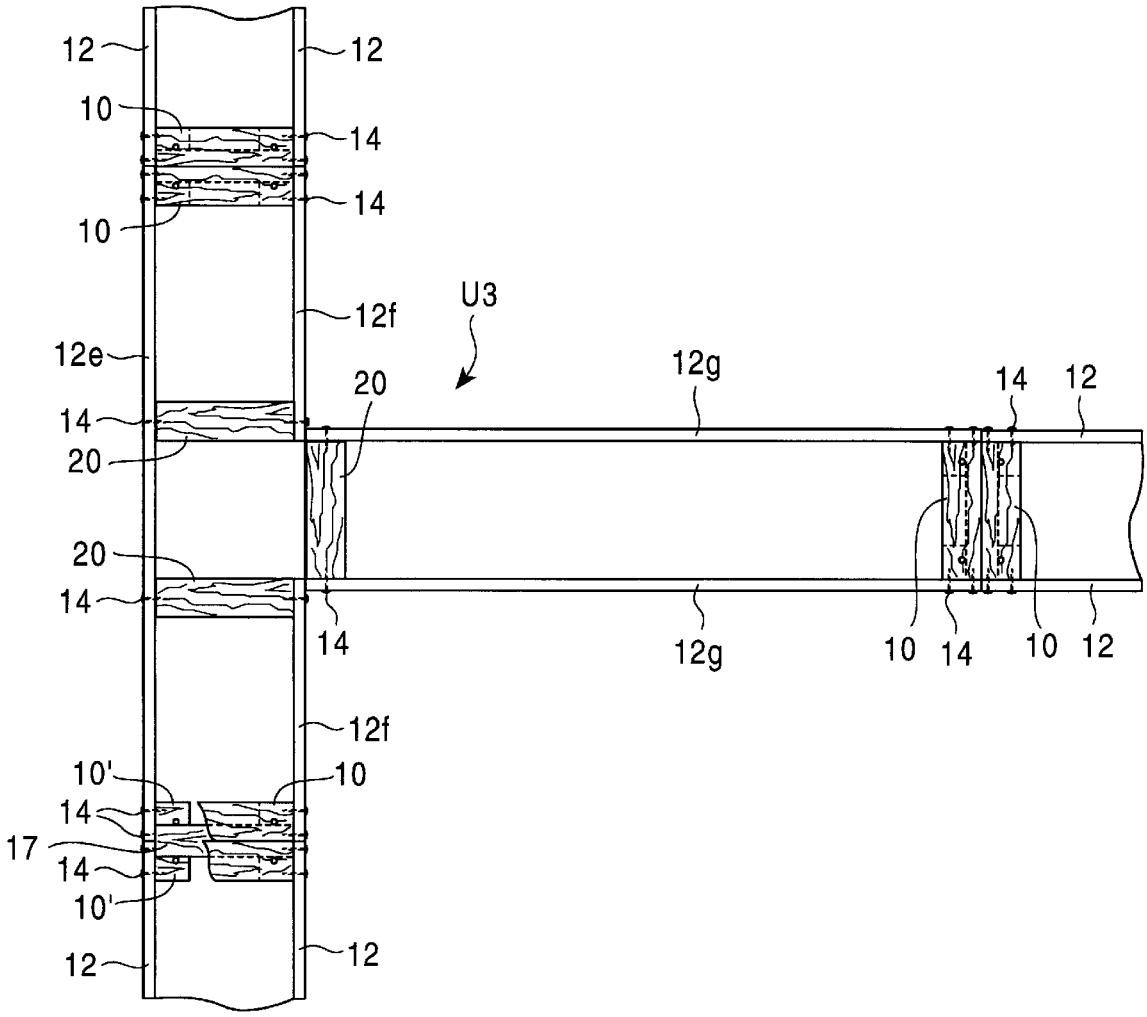
FIG. 13 is a top view of the formwork unit shown in FIG. 12.

Next, a formwork unit U3 used to install a continuous foundation that appears T-shaped as viewed from above will be described with reference to FIG. 12 and FIG. 13.

Two short formworks 12*f* are located parallel to a long formwork 12*e* at a predetermined interval, and two formworks 12*g* are located at the opposed ends of the two short formworks 12*f* in such a way as to cross the formworks 12*f*. And then, the holding members H, each comprising two formwork fixing blocks 10 arranged in the vertical direction (FIG. 12 and FIG. 13 show the divided formwork fixing blocks 10' formed by dividing the lower formwork fixing block into two) and two threaded rods 11 screwed into the vertical tapped holes 10*a* of the formwork fixing block 10, are mounted near the ends of the long formwork 12*e* and short formwork 12*f*, and near the ends of the two formworks 12*g*. In this case, as described above, the positions of the formwork fixing blocks 10 are adjusted so that the upper formwork fixing block 10 of each holding member H is constantly located at a specified position relative to the upper end surface of each of the formworks 12*e*, 12*f* and 12*g*, and the upper end surfaces of the formworks 12*e*, 12*f* and 12*g* are configured so that they are flush with each other. In this manner, the three holding members H are used to assemble the formworks 12*e*, 12*f* and 12*g* in such a way that the space in which the ready-mixed concrete C is filled appears T-shaped as viewed from above. In addition, as described above, spacers 20 that couple the formworks 12*e* and 12*f*, and the two opposed formworks 12*g* together are appropriately mounted to prevent the formworks 12*e* and 12*f*, and the two opposed formworks 12*g* from moving away from one another due to the filling of the ready-mixed concrete C between the formworks 12*e* and 12*f*, and the two opposed formworks 12*g* and to maintain the intervals between the formworks 12*e* and 12*f*, and between the formworks 12*g* at predetermined values. According to this embodiment, the spacer 20 is mounted at the side of the long formwork 12*e* between the opposed formworks 12*g* so as to couple these formworks 12*g* together. The other spacers 20 are mounted near the ends of the short formworks 12*f* parallel with the long formworks 12*e*, at the side opposed to that on which the holding member H is mounted, so as to couple the formworks 12*e* and 12*f* together.

Then, as in the linear formwork unit U1 and the formwork unit U2 that appears L-shaped as viewed from above, a level or other appropriate leveling device is placed on the upper end surfaces of the formworks 12*e*, 12*f* and 12*g* or across the opposed formworks 12*e* and 12*f* or the opposed formworks 12*g*. And then, the threaded rods 11 are rotated by attaching threaded rod rotating tools, and rotating the rotating tools. The rotation of the threaded rods 11 causes the formwork fixing blocks 10 with the formworks 12*e*, 12*f* and 12*g* mounted thereon to move in the vertical direction relative to the threaded rods 11. Doing this levels the horizontal surfaces of the formworks 12*e*, 12*f* and 12*g*. Subsequently, the ready-mixed concrete C is filled in the spaces formed between the opposed formworks 12*e* and 12*f* and between the formworks 12*g* up to the upper end surfaces of the formworks 12*e*, 12*f* and 12*g* for which leveling has been finished. Once the ready-mixed concrete C has been set, the formworks 12*e*, 12*f* and 12*g* are removed to form a continuous foundation that appears T-shaped as viewed from above. This assembly, however, may be used as a continuous foundation without removing the formworks 12*e*, 12*f* and 12*g*.

In addition, as described above, the connecting members 17 can be used to connect together the formwork units U3 that appear T-shaped as viewed from above or to couple this formwork unit U3 with the formwork unit U2 that appears L-shaped as viewed from above or the linear formwork unit U1.

Figure 14:
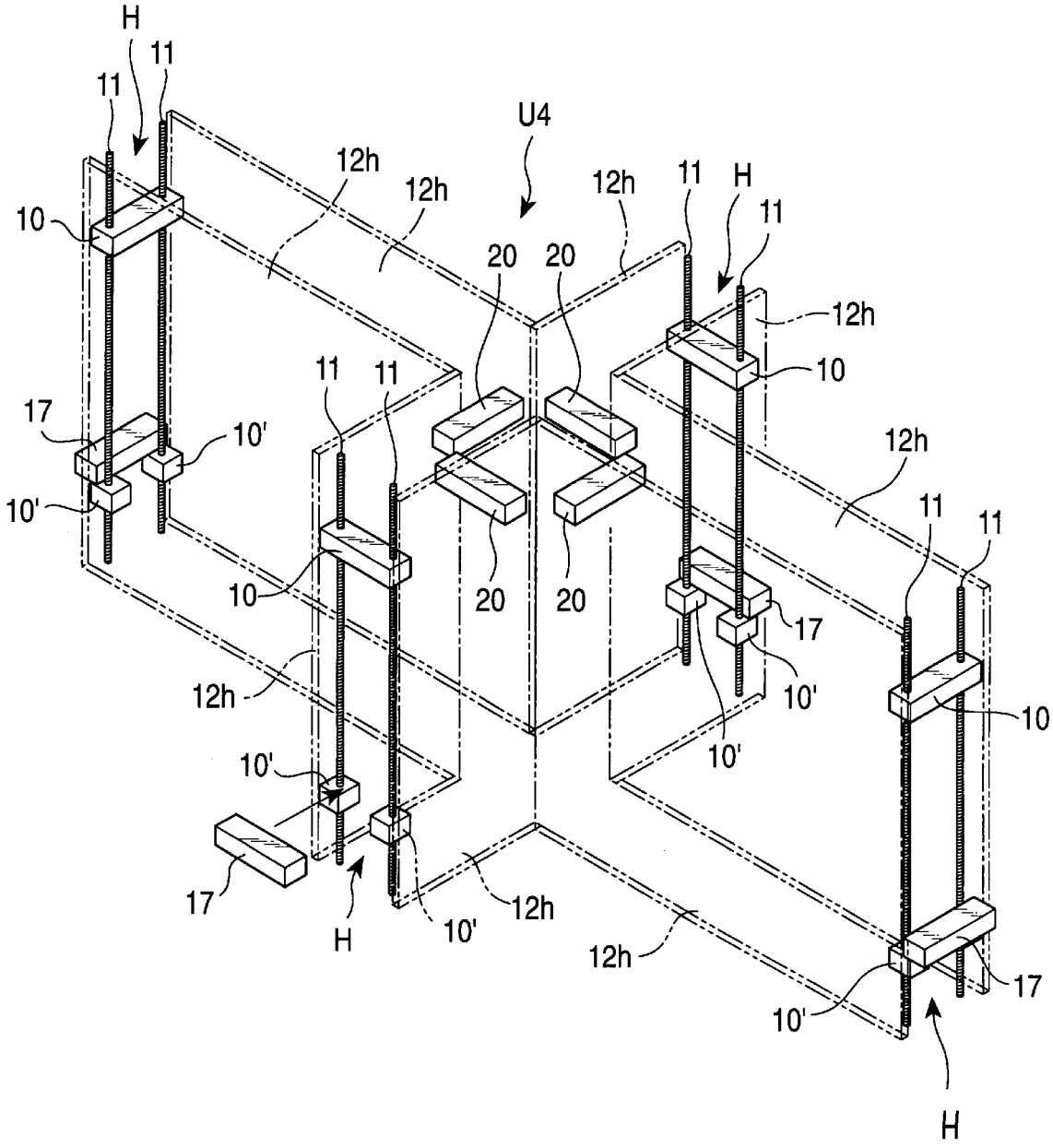
FIG. 14 is a perspective view of still another embodiment of a formwork unit of the present invention.

Next, a formwork unit U4 used to install a continuous foundation that appears like a cross as viewed from above will be described with reference to FIG. 14.

Eight formworks 12*h* are arranged in such a way as to form a space appearing like a cross as viewed from above. And then, the holding members H, each comprising two formwork fixing blocks 10 arranged in the vertical direction (FIG. 14 show the divided formwork fixing blocks 10' formed by dividing the lower formwork fixing block into two) are mounted near the ends of the opposed formworks 12*h*. In this case, as in the linear formwork unit U1, the formwork unit U2 that appears L-shaped as viewed from above, and the formwork unit U3 that appears T-shaped as viewed from above, the positions of the formwork fixing blocks 10 are adjusted so that the upper formwork fixing block 10 of each holding member H is constantly located at a specified position relative to the upper end surface of each of the formworks 12*h*, and the upper end surfaces of the formworks 12*h* are configured so that they are flush with each other. In addition, as described above, the spacers 20 that couple the opposed formworks 12*h* together are appropriately mounted to prevent these formworks 12*h* from moving away from one another due to the filling of ready-mixed concrete C between the formworks 12*h* and to maintain the interval between the formworks 12*h* at a predetermined value. According to this embodiment, four spacers 20 are mounted near the center of the formwork unit U4 so as to couple the opposed formworks 12*h* together.

Then, as in the linear formwork unit U1, a level or other appropriate leveling device is provided on the upper end surface of the formwork 12*h* or across the opposed formworks 12*h*. And then, the threaded rods 11 are rotated by attaching threaded rod rotating tools, and rotating the rotating tools. The rotation of the threaded rods 11 causes the formwork fixing blocks 10 with the formworks 12*h* mounted thereon to move in the vertical direction relative to the threaded rods 11. This action levels the horizontal surfaces of the formworks 12*h*. Subsequently, the ready-mixed concrete C is filled in the space provided between the opposed formworks 12*h* up to the upper end surfaces of the formworks 12*h* for which leveling has been finished. Once the ready-mixed concrete C has been set, the formworks 12*h* are removed to form a continuous foundation that appears like a cross as viewed from above. This assembly, however, may be used as the continuous foundation without removing the formworks 12*h*.

In addition, as described above, the connecting members 17 can be used to connect together the formwork units U4 that appear like crosses as viewed from above or to connect this formwork unit U4 with the linear formwork unit U1, the formwork unit U2 that appears L-shaped as viewed from above, or the formwork unit U3 that appears T-shaped as viewed from above.

Figure 15:
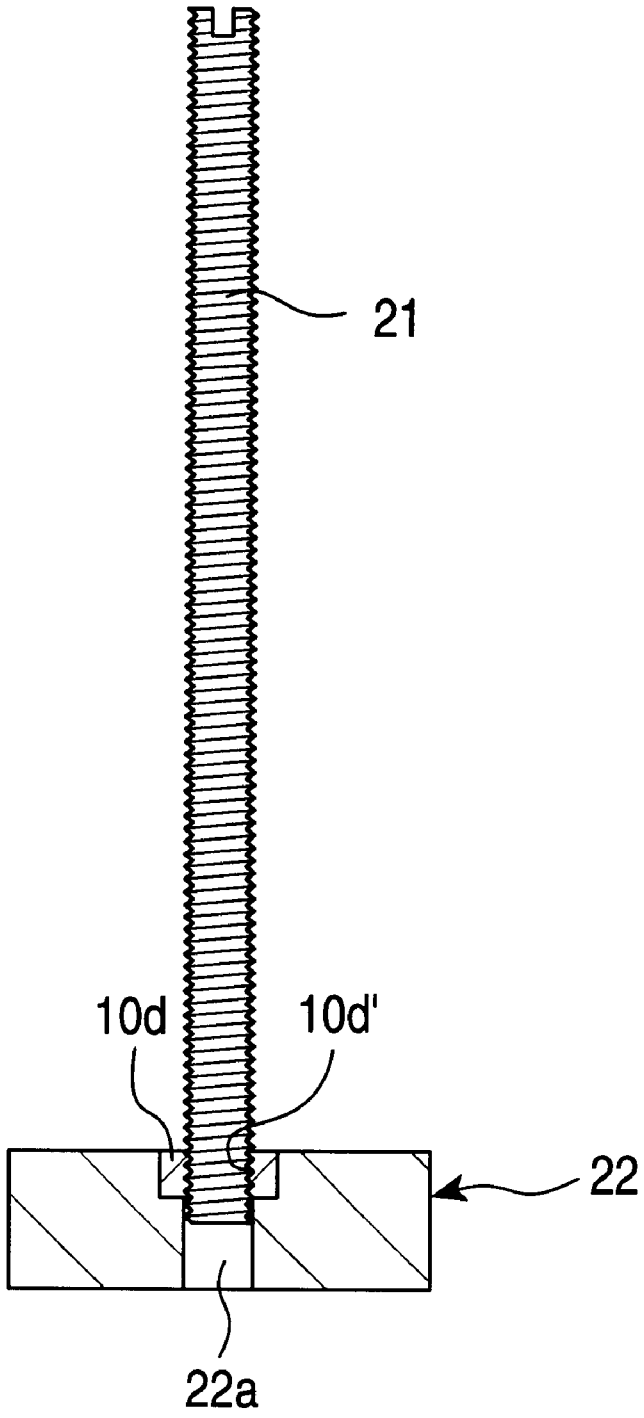
FIG. 15 is a frontal view of an anchor bolt used in the present invention including a partly sectional view.
Figure 16:
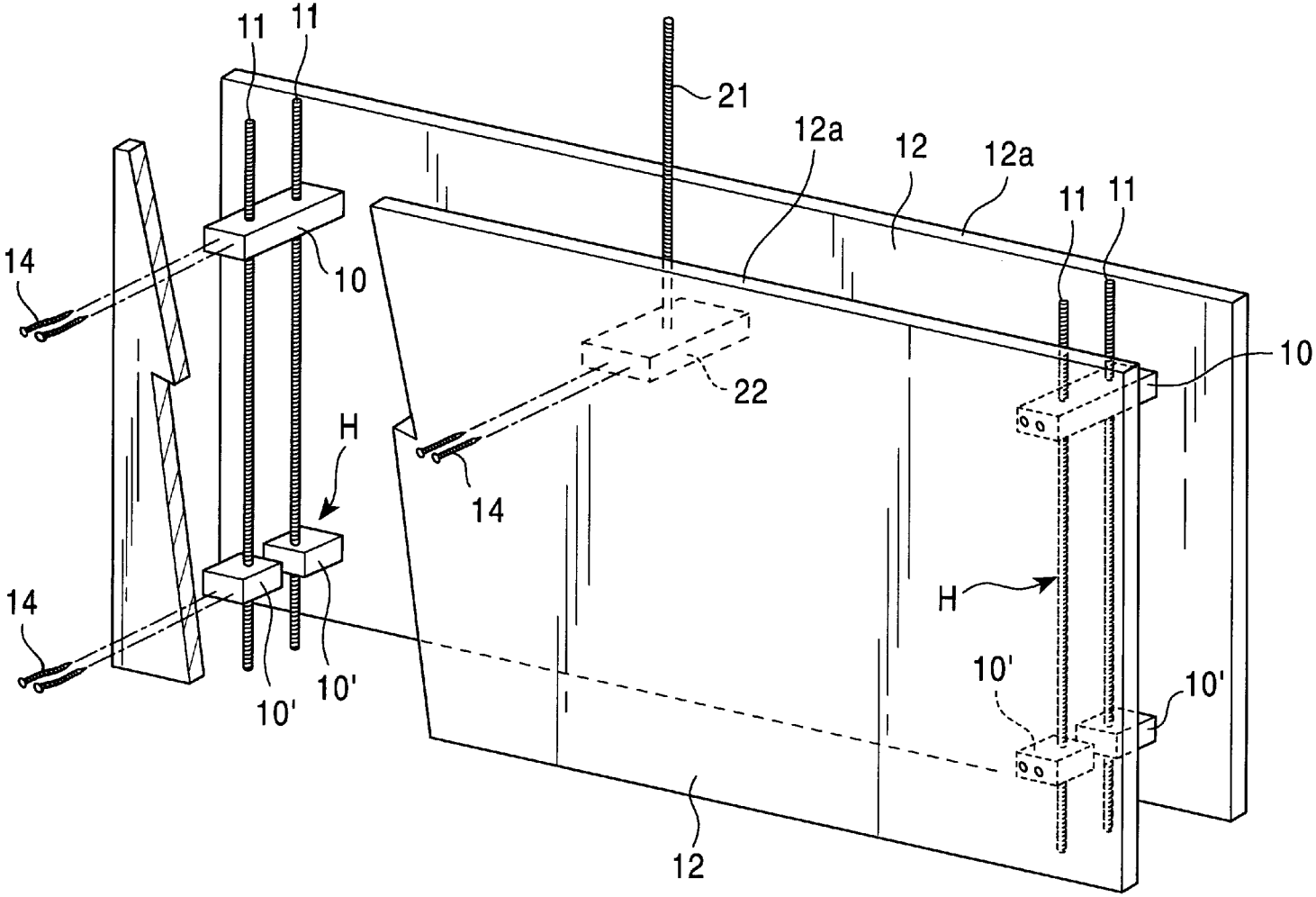
FIG. 16 is a perspective view of a formwork unit that is similar to that in FIG. 1 including an anchor bolt.

Next, the installation of anchor bolts used to mount a construction material on the continuous foundation will be described with reference to FIG. 15 and FIG. 16.

21 is an anchor bolt, and 22 is an anchor bolt fixing block similar to the formwork fixing block 10. A tapped hole in which the end of the anchor bolt 21 is screwed is formed in the anchor bolt fixing block 22, as in the formwork fixing block 10. In the embodiment shown in FIG. 15, the end of the anchor bolt 21 is screwed into a nut 10*d* with the threaded groove 10*d'* engraved in its inner circumferential surface which is fitted in a vertical hole 22*a* drilled in the anchor bolt fixing block 22 as shown in FIG. 3B.

The anchor bolt fixing block 22 in which the anchor bolt 21 is screwed is inserted and mounted between, for example, the formworks 12 constituting the linear formwork unit U1 in such a way that the anchor bolt 21 protrudes a certain distance from the upper end surfaces 12*a*. The anchor bolt fixing block 22 is mounted on the formworks 12 using appropriate fixing means such as screws 14. Subsequently, as described above, the ready-mixed concrete C is filled in the space formed by the opposed formworks 12 in such a way that the anchor bolt fixing block 22 and part of the anchor bolt 21 are buried in the ready-mixed concrete C, thereby setting the anchor bolt 21 in the continuous foundation.

Figure 18:
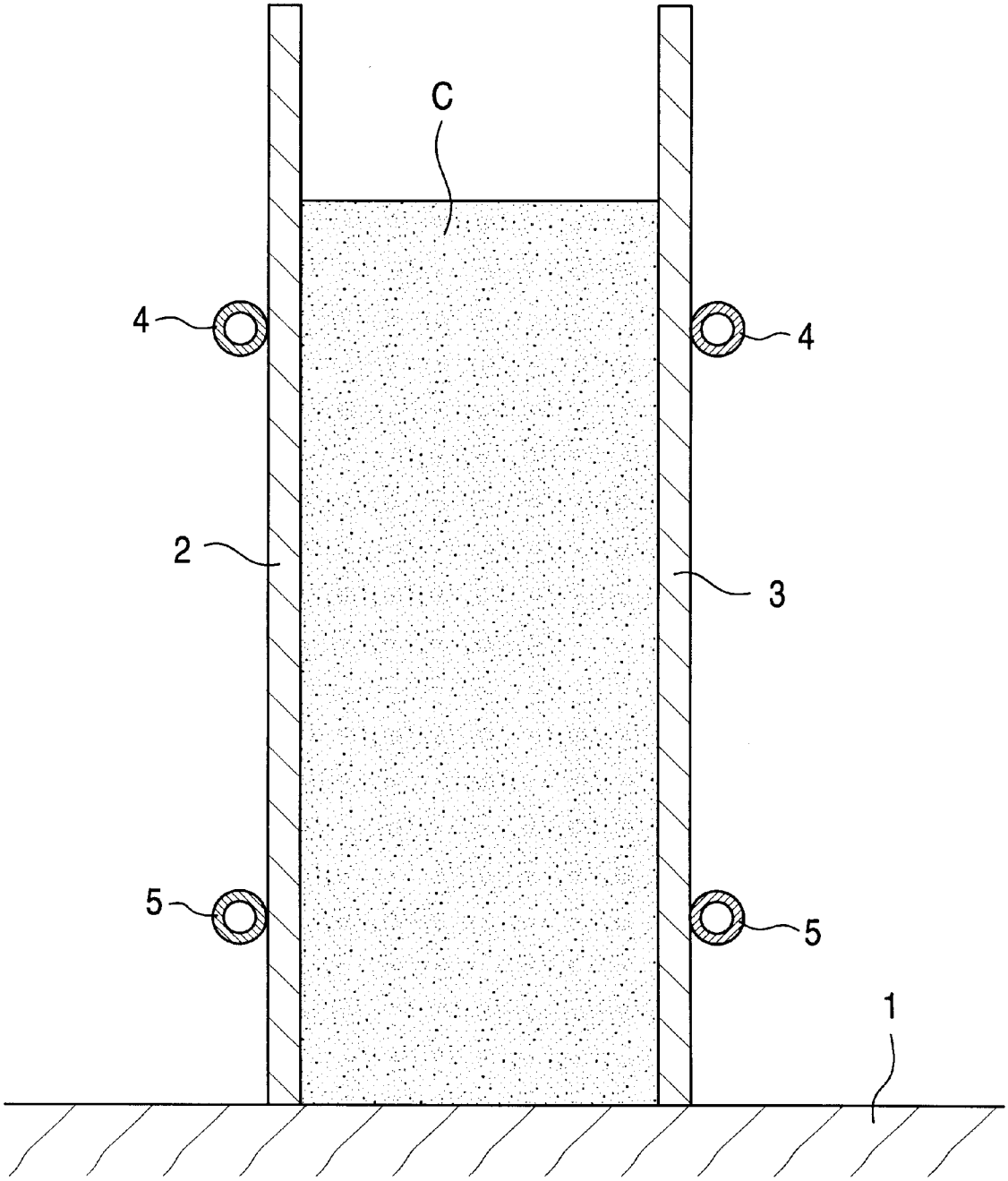
FIG. 18 PRIOR ART
FIG. 18 is a vertical sectional view of conventional formworks.

The anchor bolt is conventionally located between the formworks 2 and 3 as shown in FIG. 18 by being suspended from a plate which bridges the top surfaces of the formworks 2 and 3. When, however, the ready-mixed concrete is filled in the space provided between the formworks 2 and 3, the anchor bolt may move and cannot be easily installed perpendicularly to the continuous foundation. In addition, in order to prevent the anchor bolt from moving, the bolt is manually fixed while filling the ready-mixed concrete in the space provided between the formworks 2 and 3. Consequently, the operability of this operation is inappropriate.

The embodiment according to the present invention has the anchor bolt fixing block 22 with the anchor bolt 21 screwed therein mounted and inserted between the formworks 12, whose horizontal surfaces have been leveled, and uses appropriate fixing means such as screws 14 to mount the anchor bolt fixing block 22 to the formworks 12. Accordingly, this embodiment enables the anchor bolt 21 to be installed perpendicularly to the continuous foundation, and eliminates the need to manually fix the anchor bolt 21. These advantages improve the efficiency of the operation of filling the ready-mixed concrete in the space provided between the formworks.

Figure 17:
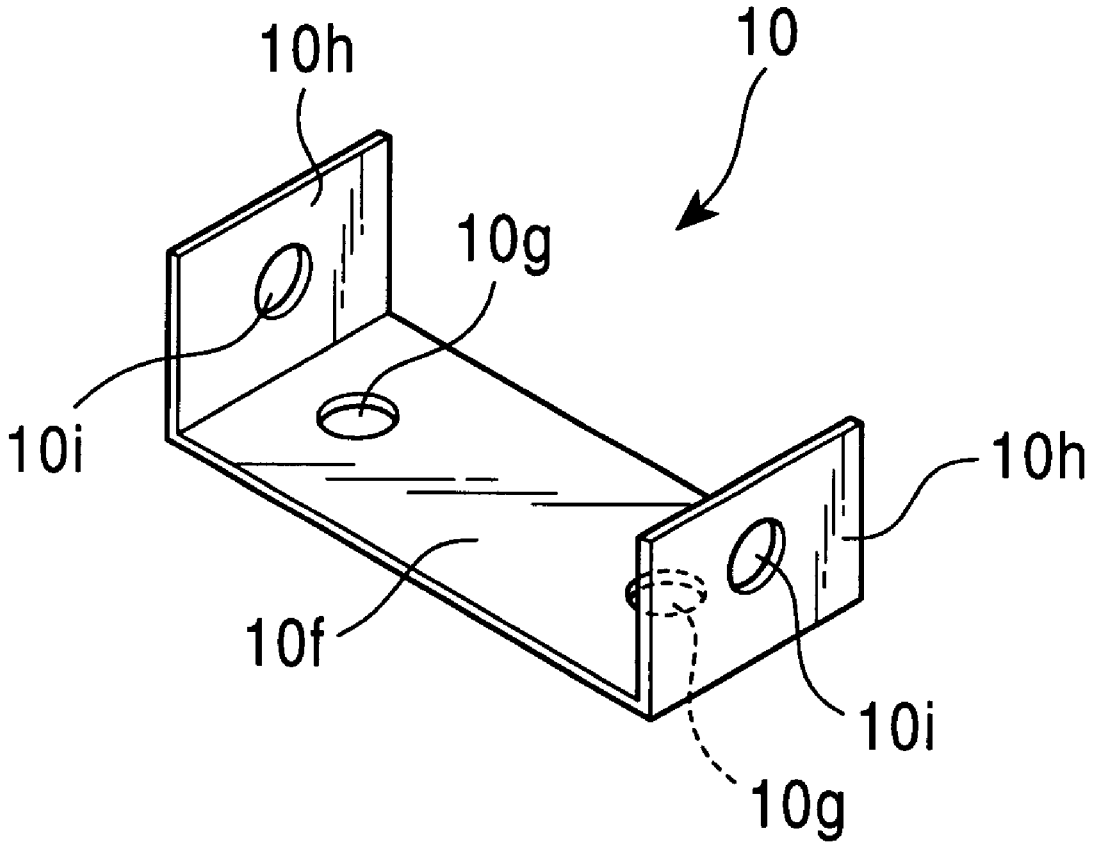
FIG. 17 is a perspective view showing yet another embodiment of a formwork fixing block.

FIG. 17 shows a formwork fixing block 10 formed by bending a band-like metal plate in such a way as to form an nearly U shape. According to this embodiment, two tapped holes 10*g*, in which the above-mentioned threaded rods 11 can be screwed, are formed in a horizontal portion 10*f* of the nearly U-shaped formwork fixing block 10. In addition, tapped holes 10*i* in which screws or bolts that pass through holes drilled in the formworks 12 are screwed are formed in opposed vertical portions 10*h* of the formwork fixing block 10. As a result, the formworks 12 can be mounted on the formwork fixing block 10 by passing screws or bolts through the holes drilled in the formworks 12 and screwing the screws or bolts in the tapped holes 10*i* formed in the opposed vertical portions 10*h* of the formwork fixing block 10.

According to the present invention, the linear formwork units U1, the formwork units U2 that appear L-shaped as viewed from above, the formwork units U3 that appear T-shaped as viewed from above, and the formwork units U4 that appear like crosses as viewed from above can be assembled in a factory or a place other than the construction site, and then connected together via the connecting members 17 at the construction site. Consequently, the space in which the ready-mixed concrete is filled can be formed in a short time without the need for highly-skilled workers, thus reducing the construction period.

Due to the above configurations, the present invention has the following effects.

The present invention improves the concrete leveling accuracy and enables even those who are not highly skilled to construct a concrete foundation with sufficient leveling accuracy.

In addition, since the formworks are mounted on the formwork fixing blocks, when the ready-mixed concrete is filled in the space provided between the opposed formworks, the formworks can be prevented from moving away from each other due to the filling of the ready-mixed concrete, and the need to dispose pipes in such a way as to sandwich the formworks is eliminated. Consequently, the installation time for the formworks and the overall construction period can be reduced.

Since the formwork fixing blocks are divided, the assembled formwork units can be used despite the use of reinforcing members having horizontal reinforcements.

Since the anchor bolt fixing block with the anchor bolt attached thereto is mounted on the formworks, the anchor bolt can be installed perpendicularly to the continuous foundation, and the need to manually fix the bolt is eliminated. This improves the efficiency of the operation of filling the ready-mixed concrete in the space provided between the formworks.

The pre-assembled formwork unit is located on the foundation member, thereby reducing the time required to assemble the formworks at the construction site and thus reducing the overall construction period.

The formworks are leveled beforehand during the assembly of the formwork unit, so the leveling can be achieved at the construction site by simply and slightly rotating the threaded rods. Consequently, the formwork unit can be leveled in a short time to reduce the construction time for a continuous foundation and the construction period as a whole.

What is claimed is:

1. A ready-mixed concrete placing method characterized by the following steps:

arranging, at a predetermined interval, at least two holding members, comprising formwork fixing blocks and threaded rods screwed into tapped holes in the formwork fixing blocks, said threaded rods disposed in substantially vertical orientation;

mounting opposed formworks on said formwork fixing blocks so as to locate said holding members in a space formed between said opposed formworks, said mounted formworks having an upper end surface;

subsequently rotating said threaded rods so that the formwork fixing blocks with the formworks mounted thereon move along the threaded rods in the vertical direction, thereby equalizing horizontal levels of the upper end surfaces of the opposed formworks; and filling ready-mixed concrete in the space provided between the opposed formworks up to their upper end surfaces.

2. A ready-mixed concrete placing method according to claim 1 characterized in that the holding member comprises two formwork fixing blocks disposed in the vertical direction.

3. A ready-mixed concrete placing method according to claim 1 or claim 2 characterized in that the holding member comprises a pair of divided formwork fixing blocks having formed therein a gap through which reinforcement can pass.

4. A formwork unit characterized in that it comprises a holding member having formwork fixing blocks and vertically oriented threaded rods screwed into holes in the formwork fixing blocks, which are tapped, and opposed formworks mounted on the formwork fixing blocks so as to locate said holding member in a space formed between said opposed formworks.

5. A formwork unit according to claim 4 characterized in that it comprises a holding member having two formwork fixing blocks disposed in the vertical direction.

6. A formwork unit according to claim 5 characterized in that the holes drilled in one of the formwork fixing blocks are unthreaded.

7. A formwork unit according to claim 5 characterized in that the formwork fixing block in the lower part of the holding member comprises a pair of divided formwork fixing blocks between which is a gap through which reinforcement can pass.

8. A formwork unit according to claim 5 characterized in that both formwork fixing blocks of the holding member each comprise a pair of divided formwork fixing blocks between which is a gap through which reinforcement can pass, and in that the formworks are coupled together using coupling blocks.

9. A formwork unit according to any one of claims 4 to 8 characterized in that anchor bolt fixing blocks with anchor bolts attached thereto are mounted on the formworks.

* * * * *